US006220114B1

(12) United States Patent
Ray

(10) Patent No.: US 6,220,114 B1
(45) Date of Patent: Apr. 24, 2001

(54) CONTROL KNOB POSITIONING DEVICE HAVING TACTILE FEEDBACK

(75) Inventor: Aloke K. Ray, Troy, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/280,944

(22) Filed: Mar. 29, 1999

(51) Int. Cl.[7] ..... G05G 5/06
(52) U.S. Cl. ..... 74/527; 74/531
(58) Field of Search ..... 74/527, 531

(56) References Cited

U.S. PATENT DOCUMENTS 3,986,410 * 10/1976 Robinson ..... 74/527
4,681,202 * 7/1987 Dinse ..... 192/129 A
4,807,489 * 2/1989 Schreiner et al. ..... 74/475
5,020,389 * 6/1991 Sigler ..... 74/553

* cited by examiner

*Primary Examiner*—David Fenstermacher
(74) *Attorney, Agent, or Firm*—Jimmy L. Funke

(57) ABSTRACT

An operator-controlled positioning device having tactile feedback which includes an elongated tubular bullet-shaped housing and a coil spring slidably engaged in said housing. The housing includes a semi-spherical cap enclosing one end. The cap is biased by the coil spring against a scale having a plurality of detents which represents gradients along the scale. The coil spring provides a biasing force such that, during relative movements between the housing and the scale, the end cap disengages each detent as it moves away, and engages each detent as it becomes axially aligned with said housing. The assembly is particularly suited for detent applications in automotive HVAC control panels.

11 Claims, 1 Drawing Sheet

CONTROL KNOB POSITIONING DEVICE HAVING TACTILE FEEDBACK

TECHNICAL FIELD

The present invention relates to control device subassemblies and, in particular, to an automotive HVAC control device having tactile feedback.

BACKGROUND OF THE INVENTION

Operation controls for heating ventilation and air conditioning (HVAC) systems in automobiles often provide tactile feedback to the operator. The feedback represents finite incremental changes or gradients as, for example, the temperature control knob is rotated clockwise from "cold" to "hot." In some applications, instead of a knob, a sliding scale is used which, for example, when moved from left to right provides tactile feedback of finite incremental changes from "cold" to "hot." One common method of providing this tactile, mechanical, feedback is to move a spring steel or plastic ball across a series of detents.

Referring to FIG. 1, there is shown one embodiment of providing tactile feedback in an HVAC detent application. The assembly includes a ball 10 positioned atop a coil spring 14. The ball 10 is held into place by grease 12 or a similar tacky substance such that the stainless steel ball adheres to the spring during handling. The other end of the coil spring is attached, directly or indirectly, to a control knob or sliding indicator. In operation, the ball 10, which can be steel or plastic, will tend to engage a detent 15 due to the biasing force of the spring 14. As the knob is rotated, or slider moved laterally, the ball 10 will engage in each detent 15 with which it axially aligns, thereby providing tactile feedback as each detent 15 contacts the ball 10. The ball, spring, and detent also act to maintain the position of the control indicator.

The prior art ball and spring assembly of FIG. 1 has several drawbacks when used for HVAC system detent applications, however. In particular, the ball and spring can become easily separated when handled or in operation. In addition, the grease required to hold the ball to the spring collects dirt which can reduce the wear characteristics of the ball, particularly in the case of a plastic ball. The grease also has a tendency to contaminate other components of the system and the assembly environment in general. The difficulty in handling the separate ball, spring, and grease assembly also increases the overall assembly costs.

SUMMARY OF THE INVENTION

It is an object of the present invention to provide a solution to the above mentioned problems.

According to the present invention, the foregoing and other objects and advantages are attained by a control device having tactile feedback which includes an elongated tubular bullet housing and a coil spring slidably engaged in said housing. The housing includes a semi-spherical cap enclosing one end. The cap is biased by the coil spring against a scale having a plurality of detents which represents gradients along the scale. The coil spring provides a biasing force such that, during relative movement between the housing and the scale, the end cap disengages each detent as it moves away and engages each detent as it becomes axially aligned with said housing.

In another embodiment, the housing includes an interior notch such that upon insertion of the coil spring into the housing, the coil spring and housing engage so as to prevent the separation of the coil spring and housing during handling of the assembly.

One advantage of the present invention is the reduced likelihood that the housing and spring separate during handling or operation as compared to the prior art spring and ball assembly.

Another advantage is reduced costs and easier assembly handling because the lack of grease as compared to the prior art spring and ball assembly.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DESCRIPTION OF THE PREFERRED EMBODIMENT

Figure 1:
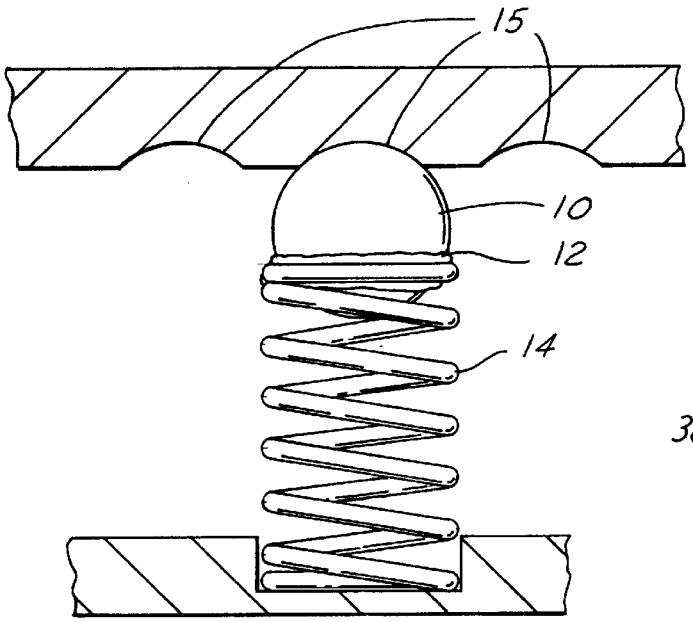
( PRIOR ART ) FIG. 1
FIG. 1 is a perspective view of a prior art ball and spring assembly.
Figure 2:
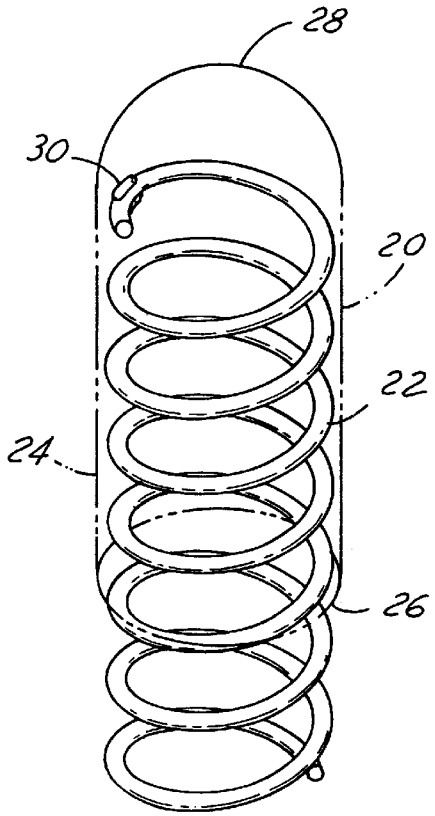
FIG. 2 is a perspective view of one embodiment of the bullet housing and spring assembly of the present invention.

Turning to FIG. 2, there is shown one embodiment of the bullet-shaped housing and spring assembly of the present invention. The assembly includes a bullet-shaped housing 20 and an elongated coil spring 22. The housing 20 has an elongated tubular body 24 which is open at one end 26 and enclosed at the other end by a semi-spherical cap 28. Preferably, the outside diameter of the compression spring 22 has a close tolerance with the inside diameter of the hollow housing 20 such that once the spring 22 is inserted into the housing 20, the housing 20 and spring 22 become an integral part. This reduces the likelihood that the spring 22 and housing 20 will become separated during handling or operation.

The semi-spherical cap 28 and elongated tubular body 24 of the housing 20 are preferably formed as a single part. In addition, the semi-spherical cap 28 is preferably polished stainless steel. It has been found that polished stainless steel provides adequate wear properties in low-wear applications such as HVAC detent applications. Thus, in detent applications for HVAC systems, the wear rate of the polished stainless steel cap 28 is nominal and no grease is required for lubrication. Because no grease is required to either improve the wear rate of the outer surface of the cap 28 or to keep the coil spring 22 and housing 20 together. The assembly cost of the housing and spring subassembly is less than that of the spring, ball, and grease assembly of the prior art.

As an alternative embodiment, the housing 20 can include a notch 30 along the elongated tubular body 24 to engage the coil spring 22 upon insertion into the housing 20. Once engaged, the notch 30 prevents the coil spring 22 from separating from the housing 20. The notch 30 could take several forms such as a flange about the circumference of the opening 26 of housing 20 or a detent in the side wall of the tubular body 24 of housing 20.

Figure 3:
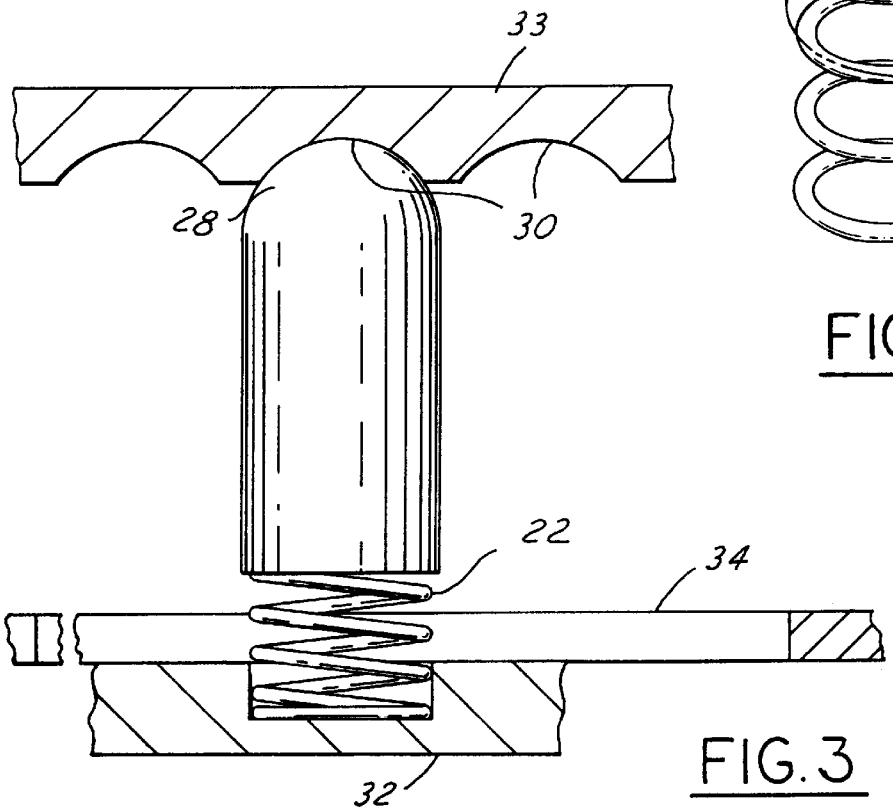
FIG. 3 is a front elevation view of one embodiment of the bullet housing and spring assembly of the present invention.

As shown in FIG. 3, in operation, the housing 20 and spring 22 assembly is operatively connected to a control knob or sliding indicator represented as control device 32. Control device 32 is typically a circular knob or an upstruck member slildably engaged in a groove on the instrument panel housing 34. Relative movement of the control device 32 causes the end cap 28 of housing 20 to move relative to the plurality of detents 30 formed in the scale member 33. The scale member 33 represents, for example, the temperature scale for an automotive HVAC system. Thus, rotation of the control device 32 in the case of a knob, or sliding of the control device 32 in the case of an upstruck member indicates the operator's desire to change the temperature. At all times, the spring 22 biases the end cap 28 against the detent 30 which is axially aligned with the subassembly. As the end cap 28 and detents 30 move relative to one another, the end cap 28 engages and disengages respectively, with each axially aligned detent 30. Of course, depending upon the application, either the scale member 32 is fixed, and the bullet and spring assembly move relative to the scale member 32, or vice versa.

From the foregoing, it will be seen that there has been brought to the art a new and improved bullet and spring assembly which overcomes the drawbacks of the prior art ball, spring, and grease assembly.

While the invention has been described in connection with one or more embodiments, it will be understood that the invention is not limited to those embodiments. On the contrary, the invention covers all alternatives, modifications, and equivalents, as may be included within the spirit and scope of the appended claims.

What is claimed is:

1. A control device having tactile feedback comprising:

a scale member having a plurality of detents formed therein;

a bullet-shaped housing member having an elongated tubular body defining an axis, and forming an interior diameter, and wear-resistant semi-spherical cap enclosing one end of said tubular body; and a coil spring slidably engaged in said housing member such that the outside diameter of said coil spring and the interior surface of said tubular body have an interference fit and one end of said coil spring extends beyond the other end of said tubular member, said coil spring providing a biasing force such that said semi-spherical cap engages each of said plurality of detents as each of said detents becomes aligned with said housing member axis.

2. The assembly of claim 1 wherein said housing member further includes a notch such that upon insertion of said coil spring into said housing member, said coil spring and said notch engage so as to prevent the separation of said coil spring from said housing member.

3. The assembly of claim 1 wherein said housing member is formed of polished stainless steel.

4. The assembly of claim 1 wherein the detents of said scale member are arranged in an arch.

5. The assembly of claim 1 wherein the detents of said scale member are linearly arranged.

6. In an operator control device for an HVAC system of a vehicle including a plurality of detents, each of said detents for receiving a corresponding positioning device, the improvement wherein said positioning device comprises:

a bullet-shaped housing member having an elongated tubular body and an opening out one end and a semi-spherical cap at the other end; and a coil spring having one end slidably engaged in said housing member, said coil spring providing a biasing force against said end cap such that said end cap engages each of said detents as said housing member becomes axially aligned with said detent.

7. The assembly of claim 6 wherein said housing member further includes a notch such that upon insertion of said coil spring into said housing member, said coil spring and said notch engage so as to prevent the separation of said coil spring from said housing member.

8. The assembly of claim 6 wherein said housing member is formed of polished stainless steel.

9. The assembly of claim 6 further comprising a control knob connected to the other end of said coil spring said control knob indicating the location of said positioning device with respect to said plurality of detents.

10. The assembly of claim 9 wherein said control knob is circular and the detents are arranged in an arch corresponding to said circular control knob.

11. The assembly of claim 9 wherein said detents are linearly arranged.

* * * * *